US009947302B2

(12) United States Patent
Canivell Grifols et al.

(10) Patent No.: US 9,947,302 B2
(45) Date of Patent: Apr. 17, 2018

(54) PEDALBOARD SUPPORT FOR ELECTRIC INSTRUMENTS

(71) Applicant: LLEVINAC, S.L., Barcelona (ES)

(72) Inventors: Jordi Canivell Grifols, Barcelona (ES); David Mañosa Ripoll, Barcelona (ES); Eulalia Llovet Vidal, Barcelona (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 15/152,952

(22) Filed: May 12, 2016

(65) Prior Publication Data

US 2016/0260422 A1 Sep. 8, 2016

Related U.S. Application Data

(62) Division of application No. 14/422,630, filed as application No. PCT/ES2014/070035 on Jan. 21, 2014, now abandoned.

(30) Foreign Application Priority Data

Jan. 23, 2013 (ES) ..... 201330078

(51) Int. Cl.

| | |
|---|---|
| ***G10D 9/00*** | (2006.01) |
| ***G10G 5/00*** | (2006.01) |
| ***G10H 1/34*** | (2006.01) |
| ***G10H 1/32*** | (2006.01) |

(52) U.S. Cl.

CPC ..... *G10G 5/00* (2013.01); *G10H 1/32* (2013.01); *G10H 1/34* (2013.01); *G10H 1/348* (2013.01); *G10H 2210/155* (2013.01)

(58) Field of Classification Search

CPC ..... G10G 5/00; G10H 1/348; G10H 2210/155
USPC ..... 84/453
See application file for complete search history.

(56) References Cited

U.S. PATENT DOCUMENTS

| | | | | |
|---|---|---|---|---|
| 2,345,650 | A * | 4/1944 | Attwood | B62D 33/044 211/182 |
| 4,641,769 | A * | 2/1987 | Ten Angel | B60R 9/045 224/314 |
| 5,659,145 | A | 8/1997 | Weil | |
| 6,209,838 | B1 | 4/2001 | Anderson et al. | |
| 6,459,023 | B1 * | 10/2002 | Chandler | G10H 1/32 84/177 |

(Continued)

OTHER PUBLICATIONS

Chris Trifilio: "Holeyboard pedal boards", Nov. 18, 2012, pp. 1-2; www.chemistrydesignwerks.com.

(Continued)

*Primary Examiner* — Jianchun Qin
(74) *Attorney, Agent, or Firm* — Knobbe, Martens, Olson & Bear, LLP

(57) ABSTRACT

A pedalboard support for electric instruments includes at least two end pieces, and at least two parallel longitudinal sections, each of which has a top surface to support pedals and at least two lower grooves forming open channels to receive attachment means. The at least two parallel longitudinal sections include at least a longitudinal groove on the top surface forming a channel which is open to the exterior. Each of the at least two end pieces joins the at least two parallel longitudinal sections together at respective ends through attachments placed in the open channels.

9 Claims, 11 Drawing Sheets

(56) References Cited

U.S. PATENT DOCUMENTS

| | | | | |
|---|---|---|---|---|
| 6,691,891 | B2 * | 2/2004 | Maldonado | G07F 11/42 211/59.3 |
| 6,723,909 | B1 | 4/2004 | Hooper, II | |
| 2011/0271821 | A1 | 11/2011 | McKinney et al. | |
| 2011/0303077 | A1 | 12/2011 | Vinciguerra | |

OTHER PUBLICATIONS

Extended European Search Report dated Jul. 27, 2016 in corresponding EP Application No. 14743613.3.

* cited by examiner

PEDALBOARD SUPPORT FOR ELECTRIC INSTRUMENTS

CROSS-REFERENCE TO RELATED APPLICATIONS

This application is a divisional of U.S. application Ser. No. 14/422,630, filed on Feb. 19, 2015 as the U.S. National Phase under 35. U.S.C. § 371 of International Application PCT/ES2014/070035, filed Jan. 21, 2014, which claims priority to Spanish Patent Application No. 201330078, filed Jan. 23, 2013.

FIELD OF THE INVENTION

This invention relates to a pedalboard support for electric instruments or electronically amplified musical instruments such as for example electric guitars.

BACKGROUND OF THE INVENTION

Pedalboard supports are also known as merely "pedalboards".

The pedalboard supports currently commercially available comprise boards or fixed structures having one or more fixed surfaces for the attachment of pedals to control the electrically amplified musical instrument or electronic instrument. As a general rule these pedals are effect pedals. The pedals may be attached by various known methods, such as attachments of the Velcro type, or the use of a rough surface, among others.

One example of a pedalboard support is that described in document U.S. Pat. No. 6,459,023 B1 which discloses a pedalboard support comprising a quadrangular supporting structure with holes within it and at least four smooth mounting surfaces fixed on that supporting structure. The holes allow the cables for the pedals located on the mounting surfaces to pass through.

Pedalboard supports of this type, and others in the state of the art, have a number of disadvantages. Firstly, it is expensive to transport them, because being three-dimensional structures they occupy a great deal of space, which makes them more expensive and makes it expensive for the musician to move them. Secondly, their surface is fixed by the manufacturer's design, which means that the musician can very often not choose his ideal arrangement, or has to acquire a very much larger pedalboard than is necessary. Thirdly, if the musician needs to enlarge the number of pedals available, in most cases this involves the purchase of a new support, with it sometimes being necessary to dispose of his old pedalboard support.

SUMMARY OF THE INVENTION

One object of this invention is to provide a solution to the abovementioned disadvantages, providing a pedalboard support which is easy to transport, modular and dismantlable, which can be expanded and to which additional components can easily be added.

In particular this invention relates to a pedalboard support of the type comprising at least two parallel longitudinal sections, each longitudinal section having a top surface to support pedals and an under surface. This support is characterised in that each longitudinal section comprises at least two grooves forming open channels to receive attachment means (attachments), in addition to the support comprising at least two end pieces, one of these pieces joining together the longitudinal sections at one of their ends through attachment means. Preferably the attachment means are threaded attachment means.

An additional object of this invention is to provide a pedalboard support comprising at least two parallel longitudinal sections, each longitudinal section having a top surface to support pedals and an under surface. This support is characterised in that the under surface comprises at least two lower grooves which form open channels to receive attachment means, the support also comprising at least two end pieces, each of these end pieces joining together the longitudinal sections at one of their ends through attachment means located in the channels.

Another additional object of this invention is to provide a pedalboard support comprising at least two parallel longitudinal sections, each longitudinal section having a top surface for supporting pedals and an under surface. This support is characterised in that at least one longitudinal section comprises at least two grooves on its top surface forming open channels to receive attachment means, the said support also comprising at least two end pieces, each of the end pieces joining the longitudinal sections together at one of their ends through attachment means. In this case the grooves located on the top surface of the support are designed to attach pedals or other accessories to the top surface through means of attachment to these grooves.

Another object of this invention is to provide a pedalboard support comprising at least two parallel longitudinal sections, each longitudinal section having a top surface to support pedals and an under surface. This support is characterised in that at least one longitudinal section comprises a set of LEDs on its top surface and at least one longitudinal section comprises at least two under grooves on its under surface which form open channels to receive attachment means, the support further comprising at least two end pieces, each of these pieces joining together the longitudinal sections at one of their ends through attachment means. In this case, the grooves located on the under surface of the support are used to attach the longitudinal sections comprising LEDs through means of attachment to the grooves.

The pedalboard support according to this invention may be assembled and dismantled by the end user, enabling the latter to transfer the pedalboard support with a minimum use of space in a dismantled condition. The threaded connection makes it possible for it to be assembled and dismantled by the user without the loss of any mechanical properties of the support. The use of longitudinal sections makes it possible to provide channels which can be used for the attachment of additional components in intermediate positions, such as a second floor of the pedalboard.

Preferably the grooves are located on the under surface of at least one longitudinal section.

Preferably the grooves are located on the top surface of at least one longitudinal section.

Preferably the grooves are located on both the top surface and the under surface of at least one longitudinal section.

Preferably the support comprises a cable-supporting piece comprising a first part with a transverse cross-section in the shape of a square "C", the opposing arms of which are inserted into two of the grooves, the first part being attached to a second part of the piece which provides at least one internal space to receive cables.

Preferably at least one longitudinal section comprises a set of LEDs on its top surface. More preferably this set of LEDs is controlled by means of remote control. Preferably the parallel sections have a space between them.

In a likewise preferable manner the sections have three of the grooves mentioned. This arrangement makes it possible to dedicate two grooves to receiving attachment means to the end pieces and the third groove (advantageously the intermediate groove) for the attachment of lifting components, such as tabs, feet, extendable feet, etc.

Advantageously this invention makes it possible to use end pieces which have components for joining sections such as those mentioned on both sides. This makes it possible to extend the length of the pedalboard support by placing sections in line joined together by means of the end pieces. The end pieces may be straight or of any other geometry, and may for example have two sets of joining components with the abovementioned sections.

In an even more preferred way the support is characterised in that the two sets of components joining the longitudinal piece form an angle between them, in such a way that the longitudinal sections attached on both sides of the end piece form an angle different than zero between them.

Another additional object of this invention is to provide a kit comprising the longitudinal sections, end pieces and attachment means for assembly of a pedalboard according to this invention by the end user. Preferably the longitudinal sections, the end pieces and the attachment means are located within the same package.

BRIEF DESCRIPTION OF THE DRAWINGS

For a better understanding, drawings of an embodiment of a pedalboard support to which this invention relates are provided by way of an explanatory but non-limiting example.

DETAILED DESCRIPTION OF THE PREFERRED EMBODIMENTS

Figure 1:
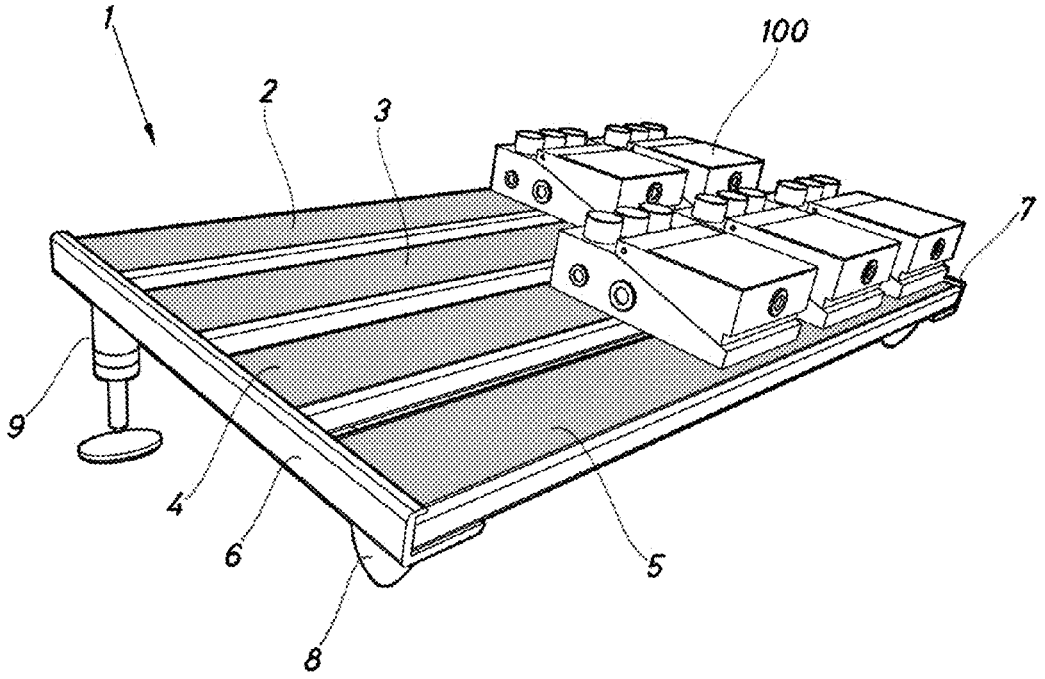
FIG. 1 shows a perspective view of a first embodiment of a pedalboard support according to this invention.
Figure 2:
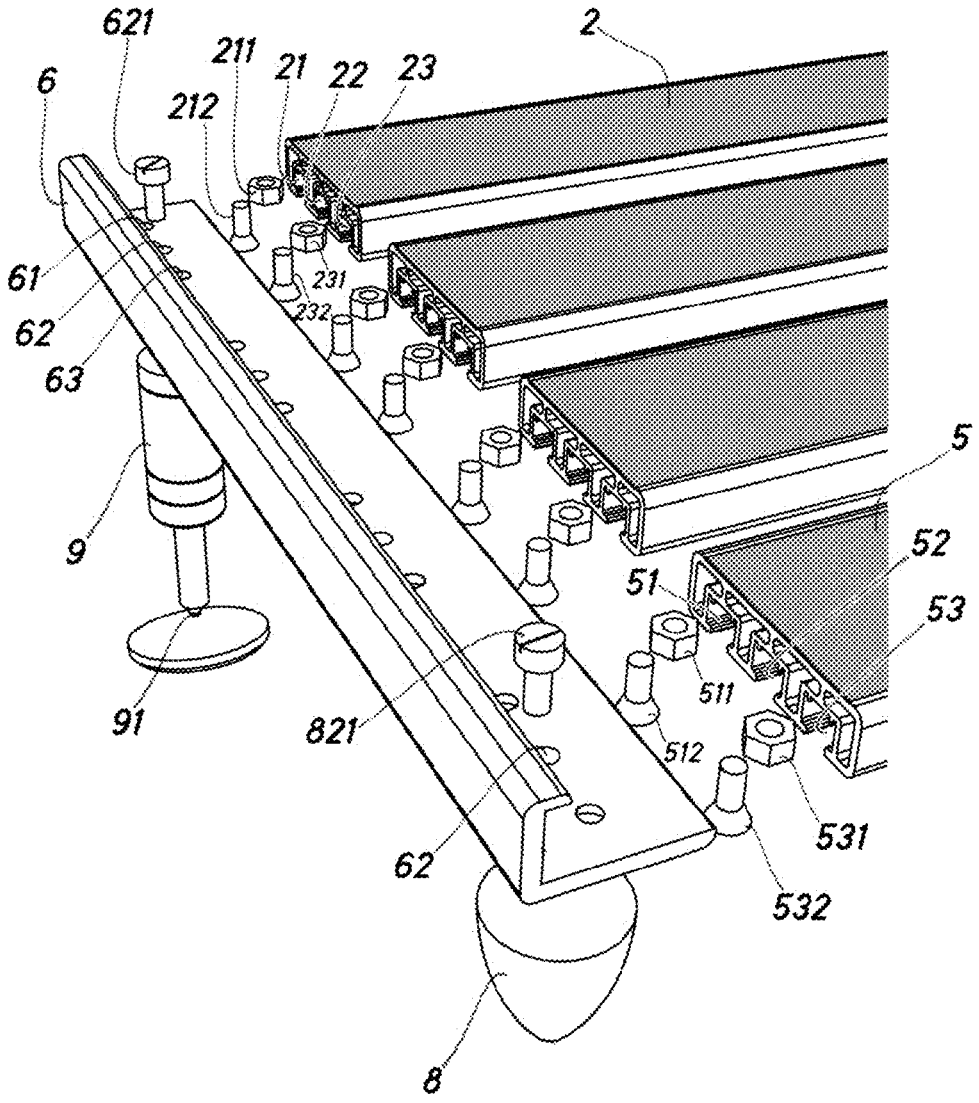
FIG. 2 shows a perspective view of a detail of the join between the end pieces and the longitudinal sections with the joining components dismantled, according to the first embodiment of this invention.
Figure 3:
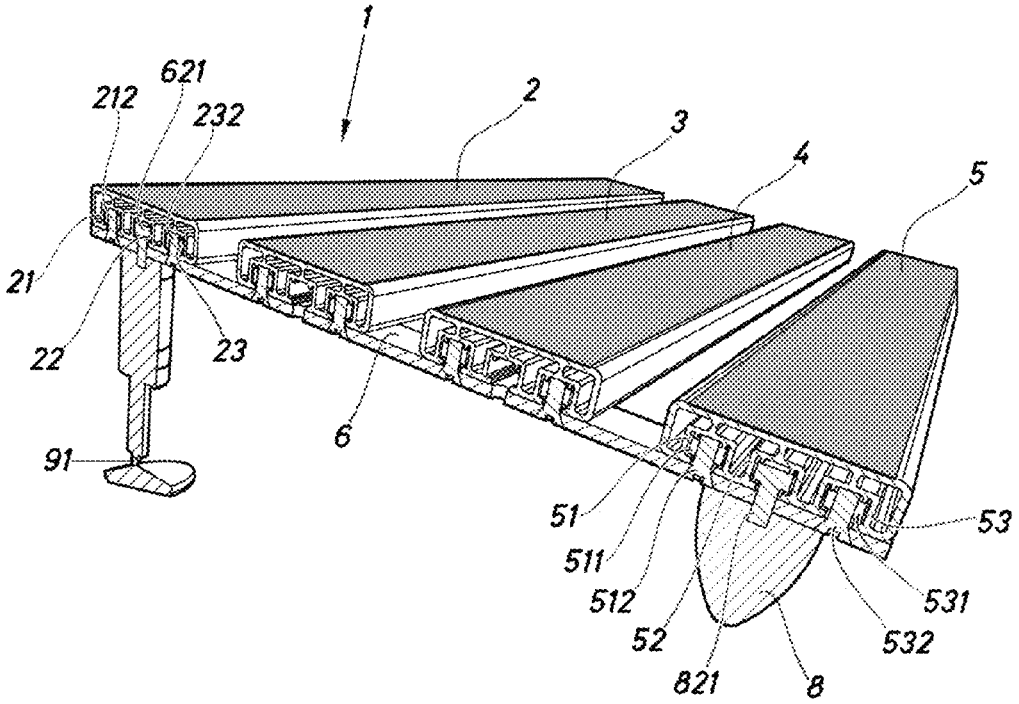
FIG. 3 shows a perspective view in transverse cross-section of the embodiment illustrated in FIGS. 1 and 2, in which the positions of the joining components in the assembled position will be seen.

FIGS. 1 to 3 show a first embodiment of pedalboard support -1- according to this invention. In the first embodiment pedalboard -1- comprises four parallel longitudinal sections -2-, -3-, -4-, -5- separated from each other. Longitudinal sections -2-, -3-, -4- and -5- are joined together by one of their respective two ends to corresponding end pieces -6-, -7- which are the same as each other. In this case, the longitudinal sections may be extruded aluminium sections. The top supporting surface for pedals -100- may be the surface of sections -2-, -3-, -4- and -5- themselves, or a rough surface bonded or adhered to the latter by any means.

Longitudinal sections -2-, -3-, -4- and -5- have a top surface to receive pedals -100- and an under surface which, according to this first embodiment, has three longitudinal grooves -21-, -22-, -23-, -51-, -52-, -53-, each one of the grooves forming a channel which is open to the exterior. Grooves -21-, -22-, -23-, -51-, -52-, -53- have small projections at their ends which allow nuts -211-, -231-, -511-, -531- to travel along these without falling out due to the effect of gravity.

Because of the polygonal shape of nuts -211-, -231-, -511-, -531- they are unable to rotate within the channels, which means that male threaded components can be screwed into and screwed out of these without the need to immobilise nuts -211-, -231-, -511-, -531-.

Of the three grooves present in each longitudinal section, -2-, -3-, -4- and -5- in the example illustrated, end grooves -21-, -23-, -51-, -53- receive nuts -211-, -231-, -511-, -531- which in turn respectively receive threaded bolts -212-, -232-, -512-, -532- for attachment to end pieces -6-, -7-. In turn, central groove -22-, -52- of the outermost longitudinal sections -2-, -5- receives a broad headed bolt -621-, -821- for the attachment of feet -9-, -8-. Feet -8- are simple supporting feet while other feet -9- can be extended by means of a support with a ball-and-socket joint -91- through which the inclination of support -1- can be adjusted.

Figure 4:
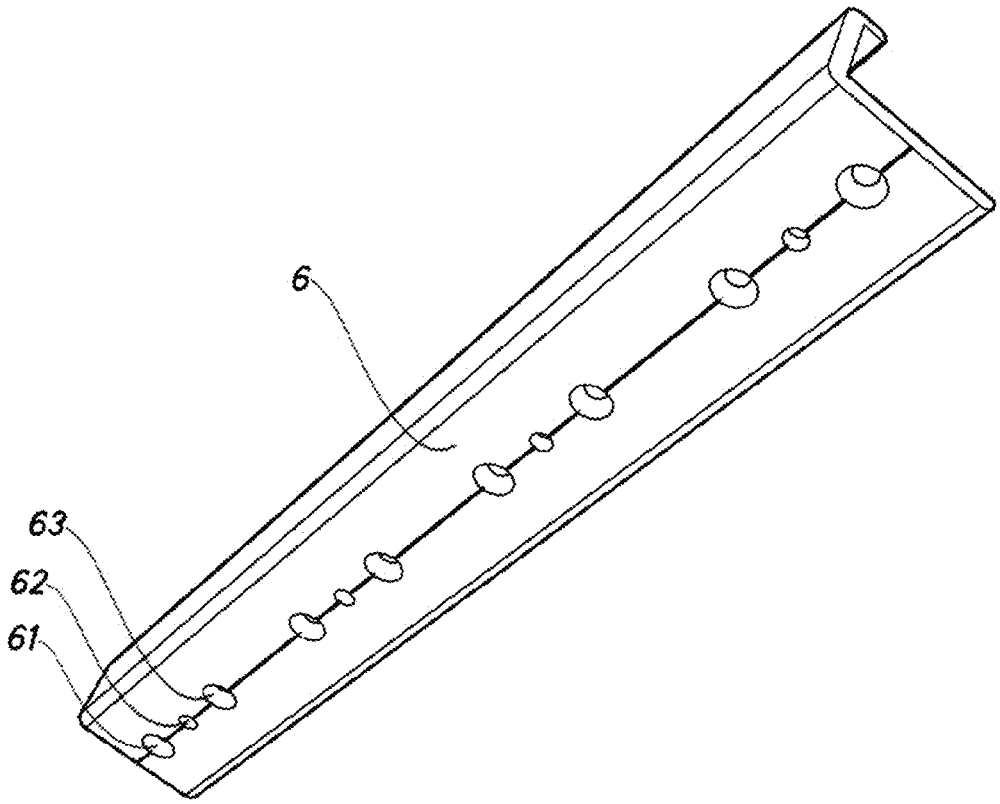
FIG. 4 shows a perspective view of one of the end pieces shown in the embodiment in FIGS. 1 to 3.
Figure 5:
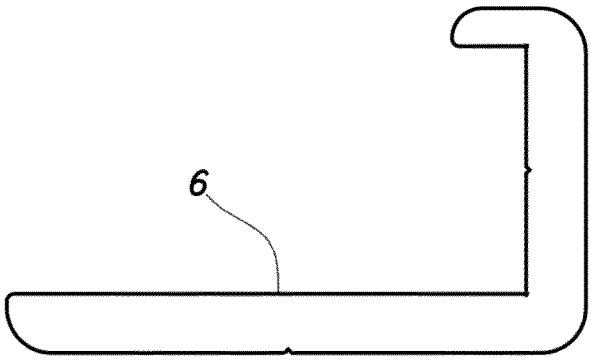
FIG. 5 shows a transverse cross-section of the end piece in FIG. 4.

FIGS. 4 and 5 show an example of embodiment of end piece or guide -6-. In the embodiment illustrated end piece or guide -6- may be an extruded aluminium section. This section has as attachment means a set of countersunk holes -61-, -63- which help to secure parallel longitudinal sections -2-, -3-, -4- and -5-. End piece -6- may be made to the desired length, and have openings for two, three, four, five or the desired number of parallel sections. There is an additional hole -62- for the attachment of feet -9-, -8- at each of the ends of end piece -6-.

Figure 6:
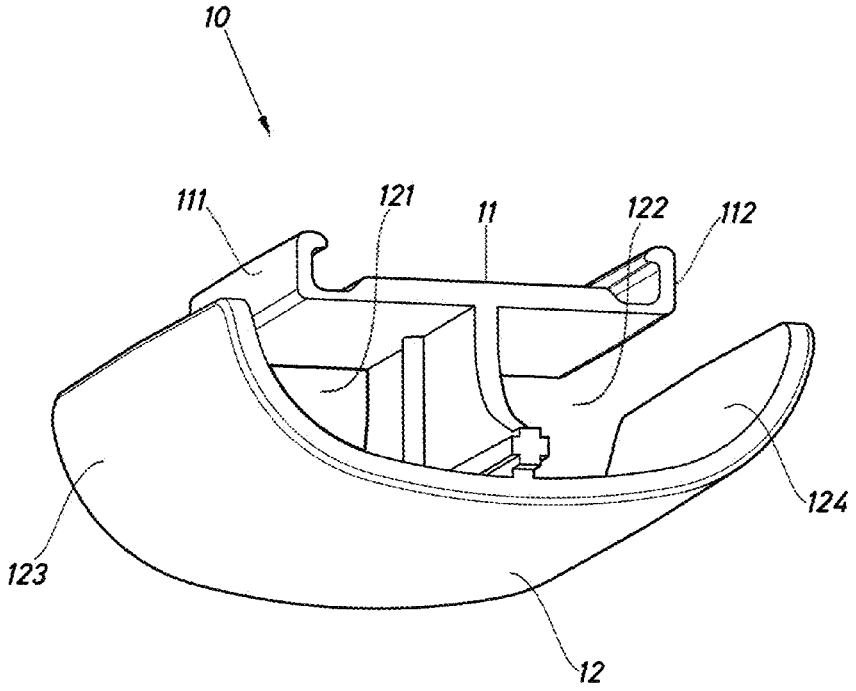
FIG. 6 shows a perspective view of a piece supporting the pedalboard cables which can be coupled to the pedalboard support according to this invention.
Figure 7:
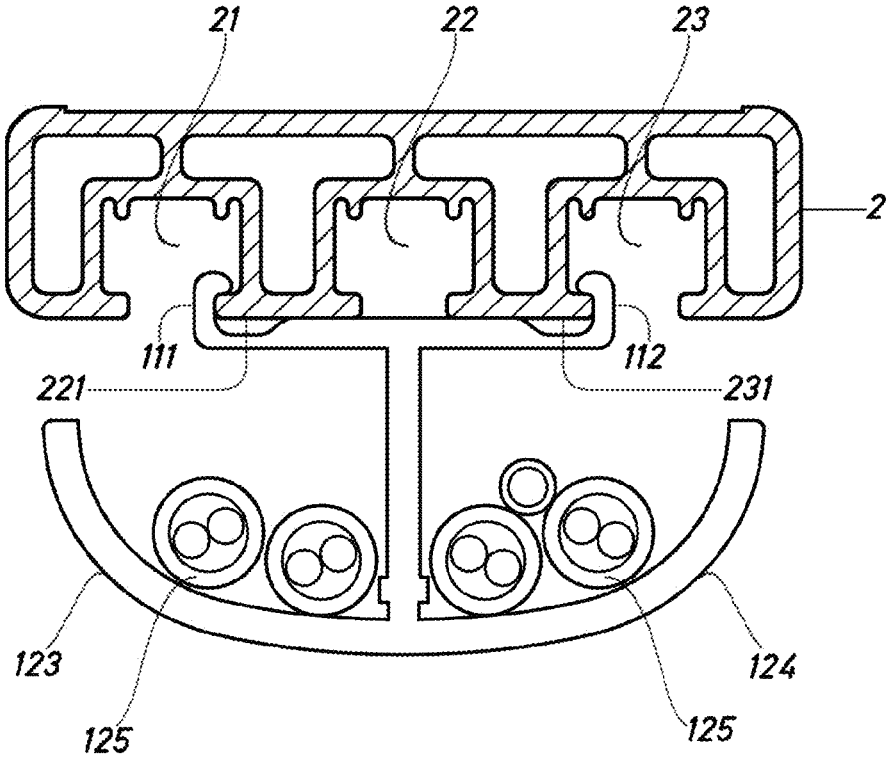
FIG. 7 shows a transverse cross-section of a longitudinal section used in the embodiment in FIGS. 1 to 3 and the cable-supporting piece in FIG. 6, in which the join between that cable-supporting piece and the longitudinal section will be seen.

FIG. 6 shows a perspective view of a supporting piece -10- for pedalboard cables. This piece -10- comprises a first part -11- having a transverse cross-section of a square "C" shape, the opposing arms -111-, -112- of which can be attached to a longitudinal section -2-, -3-, -4- and -5-. Additionally this first part -11- is joined in front of arms -111-, -112- to a second part -12- of piece -10- which defines two internal spaces -121-, -122- respectively between first part -11- and second part -12- into which the pedalboard cables are inserted and stored. By way of example, and as shown in FIGS. 6 and 7, this second part -12- of part -10- comprises a transverse cross-section of a curved "C" shape defining two opposing arms -123-, -124- in the same direction as arms -111-, -112- of first part -11-. FIG. 7 shows a transverse cross-section of one -2- of the parallel longitudinal sections used in this invention. These sections may be cut to the desired length. Each section comprises grooves -21-, -22-, -23- which in this first embodiment according to this invention are used to house nuts -211-, -231-, -511-, -531- (illustrated in FIGS. 2 and 3) which are able to move along the grooves. The junction between end pieces -6-, -7- and each of longitudinal sections -2-, -3-, -4- and -5- is also made using threaded connection. Because of its polygonal head, the nut prevents rotation. In this way any male threaded component can be screwed in without any need to hold the nut.

Additionally FIG. 7 shows the manner in which a supporting piece -10- for cables such as that shown in FIG. 6 is attached to a longitudinal section -2-, -3-, -4- and -5-. Arms -111-, -112- of first part -11- of piece -10- are inserted into grooves -21- and -23- respectively in such a way that arms -111-, -112- are fixed between projection -221- (located between longitudinal grooves -21- and -22-) and projection -231- (located between longitudinal grooves -22- and -23-) of the longitudinal section. In this embodiment the size of arms -123-, -124- of second part -12- is greater than the size of arms -111-, -112- of first part -11-, thus providing a secure support for pedalboard cables -125-.

Figure 8:
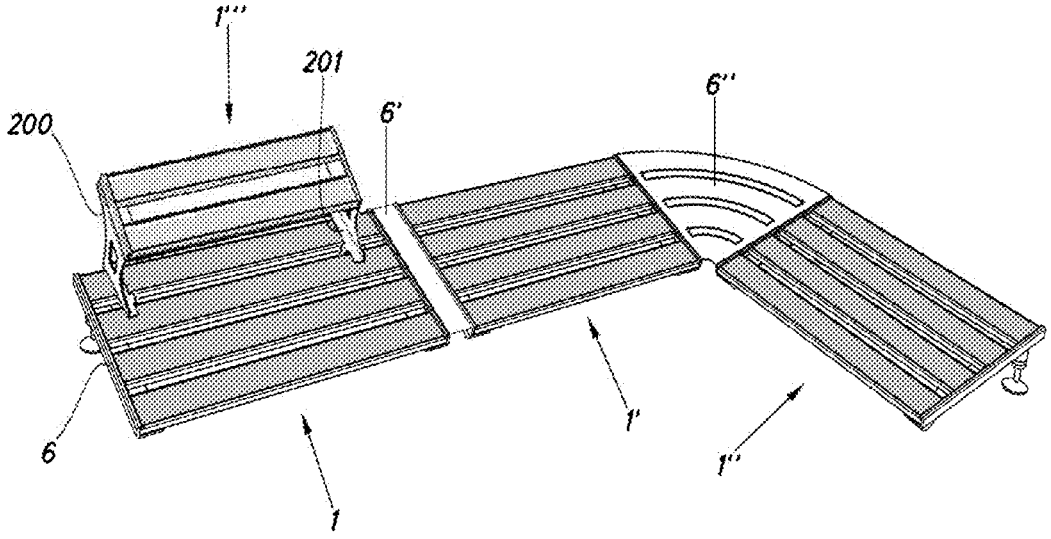
FIG. 8 shows a perspective view of a second embodiment according to this invention in which pedalboard support units similar to those in the embodiment in FIGS. 1 to 3 are joined by end pieces of different geometries, one of the supporting units having a second floor.

FIG. 8 shows a second additional embodiment for supporting the pedalboard according to this invention. This embodiment comprises three sets -1-, -1'-, -1"- of parallel sections similar to those shown in FIGS. 1 to 3. Each adjacent set shares a common end piece -6-, -6"- which joins sets -1-, -1'-, -1"- together, by joining each set to the adjacent piece. One of end pieces -6"- is an angle piece which has an angle different than zero between its two sets of joining holes to the longitudinal sections located on each of its sides, with the result that the adjacent sets -1'-, -1"- form an angle different than zero between them. Likewise there is shown a second floor -1'"- which comprises two parallel longitudinal sections of small dimensions on one -1- of the lower sets of sections. This second floor -1'"- may for example be fixed by joining pieces -200-, -201- which raise this second floor and in turn these joining pieces -200-, -201- are for example attached to the grooves in the lower surface of the sections in lower floor -1- (a junction not shown in the figures).

Figure 9:
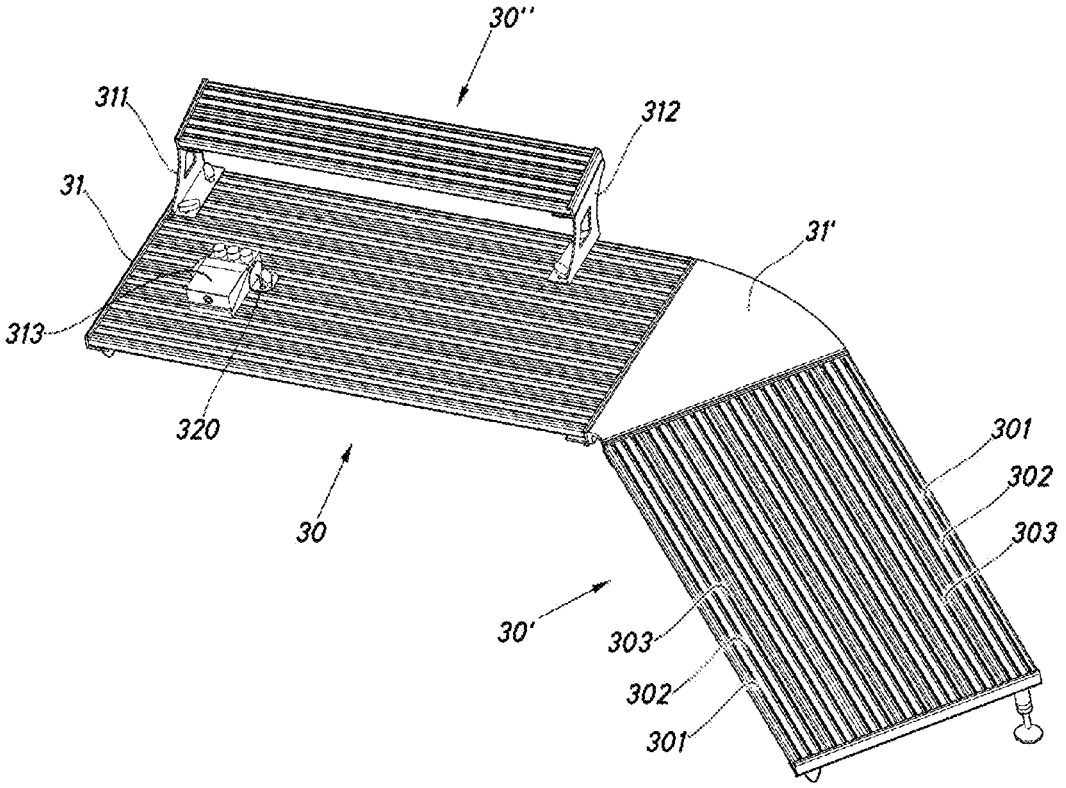
FIG. 9 shows a perspective view of a third embodiment according to this invention in which the pedalboard support units according to a second embodiment are joined together by end pieces of different geometries, and one of the supporting units has a second floor and a pedalboard.
Figure 10:
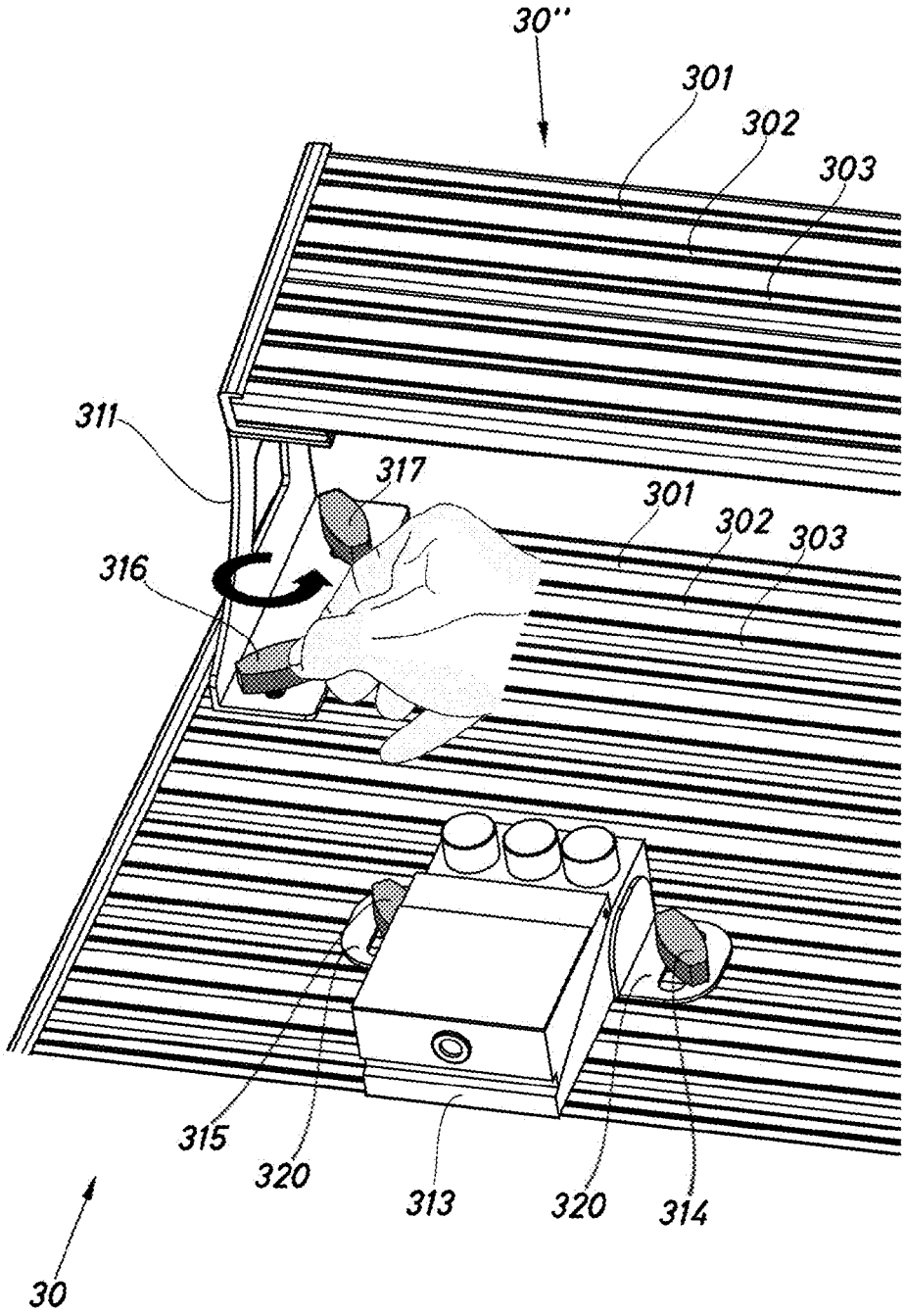
FIG. 10 shows a perspective view of a detail of the join between the second floor and the pedalboard with one of the pedalboard supporting units according to a second embodiment illustrated in FIG. 9.

FIGS. 9 and 10 show a third embodiment of pedalboard supporting units -30-, -30'- according to a second embodiment. This second embodiment of pedalboard support -30-, -30'- comprises seven parallel longitudinal sections without spaces between them. The seven longitudinal sections are joined together at each of their respective two ends to end pieces -31- which are similar to those in the embodiment illustrated in FIG. 4. In this case both the longitudinal sections and the end pieces may be extruded aluminium sections. Each longitudinal section has an upper surface to receive pedals -313- which in this second embodiment has three longitudinal grooves -301-, -302-, -303-, each of the grooves forming a channel which is open to the exterior. These open channels allow pedals -313- to be attached to the grooves located on the top surface of support -30-, -30'- through supporting pieces -320-. Supporting piece -320- is for example in an "L" shape so that a first side of that piece -320- engages one side of pedal -313- and a second side -320- of it is fixed into one of the grooves on the top surface of support -30-, -30'- through a threaded connection -314-, -315-.

Likewise there is shown a second floor -30"- which comprises two parallel longitudinal sections of shorter dimensions located above one -30- of the lower supporting sections. This second floor -30"- may for example be fixed by joining pieces -311-, -312- which raise this second floor and in turn these joining pieces -311, -312- are for example attached to the grooves in the top surface of the sections in lower floor -30- through their corresponding supporting pieces -316-, -317-.

Pedalboard supports -30-, -30'- share a common end piece -31'- joining supports -30-, -30'- together. This end piece -31'- is an angle piece which has an angle different than zero between its two sets of joining holes to pedalboard supports -30-, -30'- located on each of its sides, with the result that pedalboard supports -30-, -30'- form an angle different than zero between them.

Figure 11:
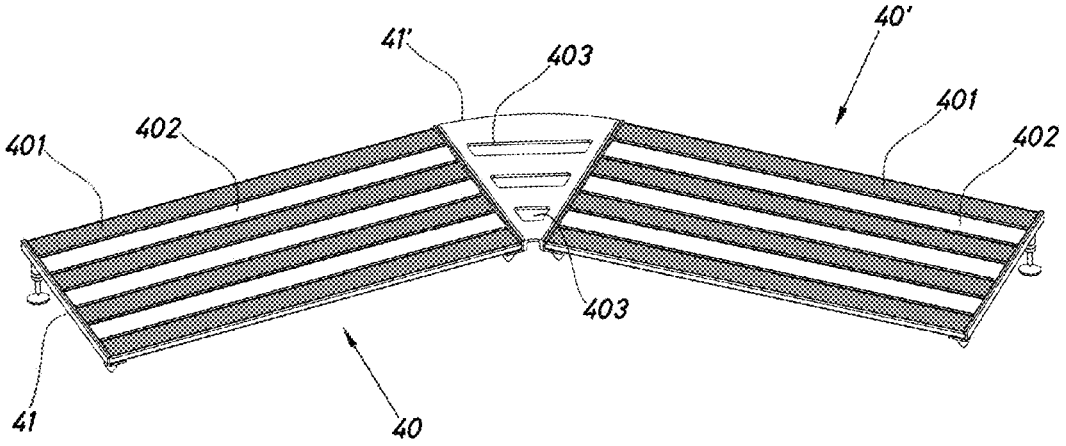
FIG. 11 shows a perspective view of a fourth embodiment according to this invention in which the pedalboard support units according to a third embodiment are joined by end pieces of different geometries.

FIG. 11 shows a third embodiment of pedalboard support units -40-, -40'- according to a third embodiment. This third embodiment of pedalboard support -40-, -40'- comprises seven parallel longitudinal sections without spaces between them. In accordance with this third embodiment, four of the seven longitudinal sections are of type -401- as shown in FIGS. 1 to 3 and three are of type -402- which comprise within them LEDs, such as for example, the RGB white light type or of the type having colours of variable intensity along its upper surface. Additionally section -402- with LEDs is of methacrylate. The two types -401-, -402- of longitudinal sections are located alternately on support -40-, -40'- and are joined at each of their two respective ends to end pieces -41- similar to those in the embodiment illustrated in FIGS. 4 and 9. Control of the LEDs on the longitudinal sections of type -402- through remote control (not shown) is possible.

Longitudinal sections of type -401- comprise a top supporting surface for pedals which may be the top surface of the section itself or a rough surface bonded or adhering thereto by any means. This top surface may comprise a surface of the "Velcro®" type in order to attach the pedals to it.

Longitudinal sections of type -401- have an under surface which in accordance with this third embodiment has three longitudinal grooves (not shown) each one of the grooves forming an open channel to the exterior. These open channels can be used to attach sections of type -402- located above the top surface of support -40-, -40'- by means of a threaded connection in such a way that a longitudinal section of type -402- is fixed through its under surface between two longitudinal sections of type -401- (not shown).

Pedalboard supports -40-, -40'- share a common end piece -41'- joining supports -40-, -40'- together. This end piece -41'- is an angle piece which has an angle different than zero between its two sets of joining holes to pedalboard supports -40-,-40'- located on each of its sides, with the result that pedalboard supports -40-, -40'- form an angle different than zero between them. In this case, end piece -41'- comprises at least 3 strips of LEDs -403- of the same type as for longitudinal sections of type -402-.

Finally all the components (longitudinal sections, end pieces and attachment members) comprising the pedalboard support according to its various embodiments according to this invention may be placed within a box in kit form so that they can be assembled and dismantled by the end user. In this way this pedalboard support can occupy minimum space in the dismantled condition. Assembly and dismantling of the same is simple for the user and in addition to this allows different variations in the combinations of the aforementioned components as desired by the user.

Although the invention has been described with regard to preferred embodiments, these must not be regarded as restricting the invention which will be defined by the broadest interpretation of the following claims.

What is claimed is:

1. A pedalboard support for electric instruments comprising:

at least two parallel longitudinal sections, each parallel longitudinal section having a top surface to support pedals and at least two lower grooves formed within said parallel longitudinal section, wherein each of the at least two lower grooves forms an open channel;

a plurality of attachments, each of the attachments received in one of the open channels at an end thereof; and at least two end pieces, wherein:

each of the at least two end pieces comprises attachment holes and at least two support holes, each of said open channels comprises an open lower side aligned with either one of said attachment holes or said at least two support holes, each of the at least two of said open lower sides receives a supporting foot through respective support holes, each of the rest of said open lower sides receives one of the attachments through respective attachment holes, such that each end piece joins said at least two parallel longitudinal sections together at respective ends thereof through the attachments placed in said open channels, and the at least two parallel longitudinal sections comprise at least a longitudinal groove on the top surface forming a channel which is open to the exterior.

2. The pedalboard support according to claim 1, wherein the channel is configured to attach an article to the at least a longitudinal groove on the top surface.

3. The pedalboard support according to claim 2, wherein the article is a pedal which is attached to the at least a longitudinal groove through supporting pieces of L shape so that a first side of said supporting pieces engages one side of the pedal and a second side of said supporting pieces is fixed into one of the at least a longitudinal groove on the top surface through a threaded connection.

4. The pedalboard support according to claim 2, wherein the article is a second floor comprising:

two parallel longitudinal sections having a shorter length than the at least two longitudinal sections, and joining pieces configured to engages with the grooves in the top surface.

5. The pedalboard support according to claim 1, wherein one of the at least two end pieces is configured to join the at least two parallel longitudinal sections on a one side and join another at least two longitudinal sections on another side.

6. The pedalboard support according to claim 5, wherein the another at least two longitudinal sections is joined such that each at least two longitudinal sections attached to respective sides of the one of the at least two end piece form an angle different than 180° therebetween.

7. A kit comprising the at least two longitudinal sections, the at least two end pieces and the attachments according to claim 1.

8. The kit according to claim 7, wherein the at least two longitudinal sections, the at least two end pieces and the attachments are placed in a same package.

9. The pedalboard support according to claim 1, wherein each of the attachments comprises a nut and a bolt, wherein each nut fits in one of the open channels and each bolt fits through one of the attachment holes in one of the end pieces and into one of the nuts, such that when said nut and bolt are tightened, the end piece securely joins said at least two parallel longitudinal sections together.

* * * * *